United States Patent [19]

Wyckoff

[11] 4,040,760

[45] Aug. 9, 1977

[54] DIRECTION-INDICATING SURFACE MARKING APPARATUS FOR ROADWAYS AND THE LIKE

[76] Inventor: Charles W. Wyckoff, 85 Pine St., Needham, Mass. 02192

[21] Appl. No.: 649,267

[22] Filed: Jan. 15, 1976

Related U.S. Application Data

[63] Continuation of Ser. No. 478,453, June 12, 1974, abandoned.

[51] Int. Cl.[2] ..... E01F 9/08

[52] U.S. Cl. ..... 404/14; 40/125 N

[58] Field of Search ..... 404/12, 14, 15, 16, 404/13, 9; 427/136, 137, 138; 350/97; 40/125 N

[56] References Cited

U.S. PATENT DOCUMENTS

| | | | |
|---|---|---|---|
| 2,185,020 | 12/1939 | Vostrez | 404/14 |
| 2,232,023 | 2/1941 | Flocks | 404/14 |
| 2,330,808 | 10/1943 | Bingham | 404/16 |
| 2,379,741 | 7/1945 | Palmquist | 404/14 |
| 2,579,467 | 12/1951 | Brickman | 404/12 |
| 2,838,408 | 6/1958 | Rindone | 404/14 |
| 2,898,825 | 8/1959 | Walker | 404/75 |
| 3,094,046 | 6/1963 | Zipelius | 404/12 |
| 3,106,878 | 10/1963 | Nagin | 404/12 |
| 3,319,542 | 5/1967 | Hansen | 404/16 |
| 3,355,999 | 12/1967 | Rusling | 404/12 |
| 3,716,445 | 2/1973 | Lemelson | 404/14 |

*Primary Examiner*—Nile C. Byers

*Attorney, Agent, or Firm*—Rines and Rines, Shapiro and Shapiro

[57] ABSTRACT

This disclosure is concerned with distinctively and unambiguously marking the directions of travel on motoring highways, airports and other surfaces with the aid of a thin novel saw-tooth marker strip that is adhered to the traveling surface and has distinctively colored successive surfaces of retroreflecting materials, sometimes oriented almost vertically or with a substantial vertical component, operable to alert the motorist or other traveler of the direction of travel approaching such surfaces, and intermediate surfaces therebetween of different color, sometimes optically diffuse and sometimes retroreflective, to indicate the opposite direction of travel.

14 Claims, 4 Drawing Figures

DIRECTION-INDICATING SURFACE MARKING APPARATUS FOR ROADWAYS AND THE LIKE

This is a continuation application of Ser. No. 478,453, filed June 12, 1974, now abandoned.

The present invention relates to methods of and apparatus for direction-indicating surface marking and the like, being more particularly concerned, for example, with marking highway surfaces in such a manner that the mark will visually indicate to a motorist in a distinctive color, such as red, that he is proceeding in an improper direction of travel. Clearly similar applications exist in airport runway surfaces and on other surfaces, as well, for the same or similar purposes and functions. Accordingly, the term "surface" will be used hereinafter in a general sense, as will the words "horizontal" and "vertical" be used sometimes in connection with orientation of the parts in an illustrative and relative and thus a generic sense, also, since the invention is applicable in many geometric configurations. The term "color" is also used herein in a broad sense to embrace both spectral wavelengths and different shades or hues that provide different surface appearances.

The serious problem has long existed in all major highways of the world of alerting motorists to instant recognition of an improper direction of travel as they proceed along the highway. All too often, an unsuspecting motorist proceeds in the wrong direction of travel and heads directly into opposing traffic. This is a surprisingly common occurrence on divided highways, particularly when the lanes are separated by some distance between them. In such instances, even under ideal weather and visibility conditions, each lane appears to the motorist to be a separate highway without clues to indicate whether it is a two-directional traffic road or a single direction highway. Nor is there any clue indicating either the proper or improper flow of traffic. Initial road signs and other devices that have been in use have proven far from fool-proof.

Recognition of the wrong way to proceed, whether immediate or not, is often exceedingly difficult and sometimes impossible for the motorist to decide. For example, during heavy rain or dense fog, and especially at night, the ensuing confusion has led to many fatal accidents of head-on collisions.

Many dual-lane divided highway motoring surfaces, moreover, have delineator posts positioned along the side of the roadbed every few hundred feet. These delineators usually contain a highly reflective material at their tips so that, at night, with headlight illumination, they may serve visually to indicate the edge of the road. The highly reflective optical material generally used is known as a "retroreflector"; that is, a material which returns nearly all of the incident light back along the same direction from whence it came. These reflectors can be of many geometric forms such as a plurality or series of small members such as cubes, pyramids, Fresnel reflectors, or tiny transparent glass or plastic rods, fibers or spheres secured to a light-colored diffusely reflecting surface. The latter is the basis of a commercially available product marketed, for example, by Minnesota Mining and Manufacturing Company, under the trademark "Scotchlite", and incorporated into many highly reflective street signs, stop signs, and other highway visual warning signs, as disclosed, for example, in U.S. Pat. No. 2,407,680. This optical material has also been incorporated with a paint base which may be applied to many surfaces, such as roadways, either by a spray or brush technique, as described, for example, in U.S. Pat. No. 2,824,502.

All of these optical materials are highly efficient retroreflectors at a normal angle of incidence, and so return a large percentage of the incident light back upon itself. As the angle of incidence becomes more oblique, however, these materials become less efficient in the percentage of light they return as retroreflectors. When applied to the surface of a highway to serve as a visual marker, such as a traffic lane divider, as for example, in U.S. Pat. No. 2,232,023, such optical materials are thus only slightly better than ordinary paint, especially when observed by automobile headlights at night, and have not served adequately to solve the above-mentioned problem. Furthermore, their visual appearance is the same when viewed from all directions and thus they do not provide direction discrimination.

The reflected light may be made to appear in a given color by proper selection of reflecting material or binder in which the optical reflecting elements are imbedded. For example, if the background is white, then the retroreflected light will be white. If the optical elements are disposed on a green background, the reflected light will be green. Likewise a red appearance will result from imbedding the optical elements in a red binder or background.

It should be obvious, however, that if a red background has been selected, the appearance of the reflected light will always be red irrespective of the viewing angle. Thus, a road stripe using a red background material in which the optical elements are contained, will always have a red appearance regardless of the viewing angle. This fact has thus precluded use of such a material per se to serve the purposes of a visual highway wrong-direction traffic color indicator in view of its same color appearance from all angles of view.

While it has been proposed to make highways more illuminable, as by constructing roadway surfaces with blocks that would impart a saw-toothed roadway configuration, as in U.S. Pat. No. 2,330,808, thus to reflect light incident upon the road surface from headlights more generally back toward the vehicle to render the road surface more visible, this does not provide unambiguous discrimination of direction of reflection, it inherently produces road chatter and vibration, and, indeed, it is exorbitantly expensive and not adaptable to be employed in existing roadways and the like. Similarly, the concept of using lenses to improve visibility, even with retroreflective materials, as in U.S. Pat. No. 3,292,507, is subject to similar road chatter, non-universal adaptability for application, and expense disadvantages, among others. Similar disadvantages reside in the use of various-shaped blocks with retroreflective materials, as in U.S. Pat. Nos. 2,579,467 and 3,418,896. Other proposals for improved visibility and marking have been made as in U.S. Pat. Nos. 1,740,501; 1,850,370; 1,981,206; 2,256,636; 3,103,859; 3,252,376; 3,291,011; 3,355,999; 3,499,371; 3,529,517; and 3,575,773; but, again, these all lack either the discrimination or other practical features before-discussed that underlie the problem of the present invention.

It has been discovered that through the use of a novel thin saw-toothed strip combined with critically positioned distinctively colored retroreflective material on one set of parallel surfaces, and sometimes optically diffuse and sometimes retroreflective differently colored reflecting surfaces therebetween, all of the above-described disadvantages of prior markers are admirably overcome; and, indeed, the retroreflector is not subject, in its novel orientation herein, to its customary lack of angular discrimination, before discussed, in prior art uses of the same and requires no lens or other light-return supplementing apparatus as in said U.S. Pat. No. 3,292,507. A synergistic combination effect is thus produced, that constitutes a highly novel solution to the problems underlying the invention.

An object of the present invention, accordingly, is to provide a new and improved method of and apparatus for direction-indicating surface marking, as for such purposes as visually warning motorists when they are proceeding in an improper direction, and for other applications.

A further object is to provide such a novel method and apparatus employing, in a critical manner, retroreflective materials such as to cause a distinct color or hue to be observed over a wide range of distances when observed from one direction, and a totally different color or color appearance, such as none at all, when viewed from any other direction.

Another object of the invention is to provide a more efficient retroreflector for use at very oblique angles.

A further object of the invention is to provide landing strips or airport runway markers which will delineate the edges of such runways to the operators of aircraft using these facilities.

Other and further objects will occur hereinafter and are more particularly delineated in the appended claims. In summary, however, from one of its aspects, the invention contemplates a direction-indicating surface marker apparatus comprising a thin strip of successive contiguous wedges of saw-tooth cross-sectional configuration. In one configuration, each wedge has a relatively long surface inclining upwardly at a small acute angle and a relatively short surface inclining downwardly substantially normal to the upwardly inclining surface, said downwardly inclining surfaces being highly reflective, integrally covered by retroreflective means, and presenting a predetermined color, and said upwardly inclining surfaces being differently colored and of optically diffuse reflecting properties. In another embodiment, the wedge is more triangular shaped, but with the surface angles with the vertical not exceeding about 45°. The diffuse surfaces, moreover, may be replaced by retroreflective materials, also. Preferred constructional details are hereinafter set forth.

In further summary, in one embodiment, a visual warning system would comprise an optical retroreflecting material which would appear as a red color when observed from one direction and a distinctly different color or hue when observed from another direction. In another embodiment, the optical material would be highly retroreflective when observed from a given direction but would have little if any reflection and thus have a different color appearance when viewed from any other direction.

This optical material is preferably secured to the surface of a paved highway or runway in the form of circles, squares, arrows, letters, solid unbroken lines, or dashed lines in much the same way that paint is applied to road surfaces.

The invention will now be described with reference to the accompanying drawing.

FIG. 1 of which is a longitudinal sectional view of a preferred embodiment applied to a marker strip or the like on a highway or similar surface;

Throughout the following description of this invention, reference will be made to optical elements such as refractive spheres, cylinders, rods, or fibers. It should be understood that these elements may be made as individual elements of glass, plastic, or other transparent optical materials, or they may be comprised of molded or otherwise pre-formed glass or plastic sheets as described, for example, in some of the above-referenced patents.

Figure 1:
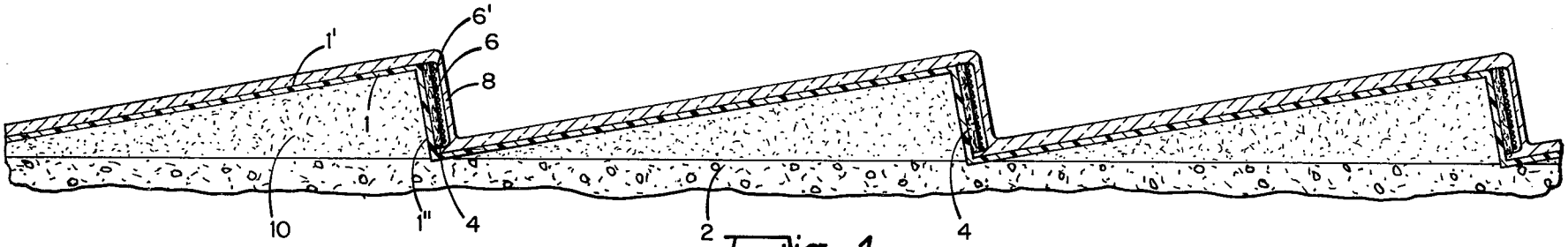
Figure 2:
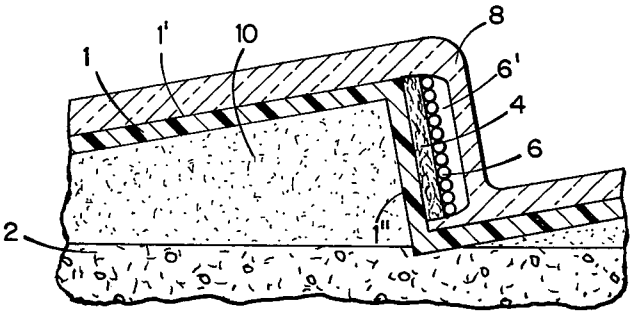
FIG. 2 is a similar fragmentary view on an enlarged scale.

Referring to FIGS. 1 and 2 of the drawings, the marker strip of the invention is shown for illustrative purposes as comprising a zig-zag or cross-sectionally saw-toothed configuration 1, preferably preformed into successive contiguous in-line wedges. The thin strip, unlike prior art blocks, lens devices and the like, is adapted for facile and universal attachment to road and other surfaces by thin adhesive coatings 10 of thermal-setting cements, including rubber hydrochloride, "Glyptal" No. 7424 (General Electric) and "Duraplex" D-65-A (Rohm and Haas), and other similar well-known adhesives.

In this embodiment, each has a relatively long surface 1' inclining upwardly at a relatively small acute angle to the horizontal, such as the roadway surface 2, so as to appear substantially flat, and a relatively short surface 1'' inclining downwardly substantially normal (90°) to the upwardly inclining surface 1', thus making a similar small acute angle with the vertical and presenting a nearly vertical orientation.

For reasons later explained, the relatively flat and long surfaces 1' of the marker, intermediate the nearly vertical surfaces 1'', are provided with optically diffuse surfacing, such as white paper, flat paint or phosphor material (such as Sylvania Electric Products CRT phosphor P-2, No. 145) or the like, so as diffusely to scatter in all directions, and in that sense "reflect", incident light, including in the direction of the line of sight from the motorist approaching the strip in the correct or proper direction from left-to-right. Thus, that motorist, irrespective of distance from the strip 1, will see a white marker arrow or line indicating that the car is traveling in the correct direction along the highway surface 2.

Upon the nearly vertical planar, parallel, short surfaces 1'', however, in accordance with the invention, a composite retroreflecting system is applied, shown comprising a highly reflective back surface 4 (such as a reflecting silver or specular white reflecting layer), one or more layers 6 of optically refracting retroreflector spheres, fibers, cylinders or other well-known elements, as previously described, contained in a binder 6', as is well known, and preferably covered, as is the rest of the strip 1, with a protective low-friction, hard-wear, and even waterproof layer 8. This arrangement is integrally constructed thus to retroreflect basically in the same direction only, the incident light, directed normal to the short almost vertical surfaces 1'', so-labelled, at small acute angles relative to the roadway surface, along the line of sight of a motorist proceeding in the wrong direction from right-to-left.

By coloring the retroreflecting elements 6 themselves, say red, and/or coloring the transparent binder 6' with an appropriate fluorescent dye, and/or using the layer 4 to provide a transparent color filter spacer, as well, the motorist approaching from the wrong direction will selectively and directionally see a reflected red warning line both in daylight and under the action of the motorist's headlights and over a large range of distances.

Figure 3:
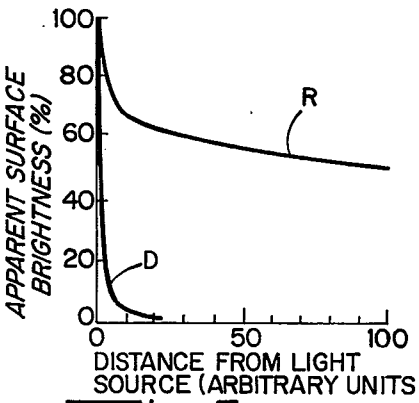
FIG. 3 is a graph illustrating the optical phenomena underlying part of the operation of the invention.

Underlying the efficacy of the invention, however, is the phenomenon, among others above explained, that is illustrated in the graph of FIG. 3. It has been found that diffuse surfaces, such as the before-mentioned white paper, which are closer to the light source, appear to be brighter than those surfaces farther away from the light source, as shown in curve D; the decrease in apparent brightness following the well-known inverse square law. With the retroreflecting surface 6, however, such as the before-mentioned "Scotchlite" material, the distance between the point light source and the retroreflector makes very little difference upon the apparent brightness, as illustrated in curve R. Those surfaces at great distances appear to be nearly as bright as those nearest the light source, with surface reflection losses preventing the result from remaining at 100% level.

In view of this phenomenon and the critical geometric and other constructional arrangements of the invention, highly effective wrong-way indicators may be constructed and used as before suggested or even as side-of-the-road or other markers, with the wedges mounted on posts, crash rails or other surfaces in the vertical plane. Suitable tested structures have employed about a 10° acute angle for the wedges, such being found useful over a wide range of approaching distances of the motorist.

In practice, thin strips suitable for highway, airport or related uses may be formed in various ways.

For example, instead of coating the short near-vertical faces 1'' of the wedges with a retroreflecting material 6–6', it is possible to coat this material as alternating lines and spaces of the appropriate width on a flat plastic surface and then form the saw-tooth pattern with the retroreflecting lines forming the short nearly vertical faces. Offset lithographic printing techniques have been developed to such a refined degree that registration is not a serious problem of either print-coating the various layers in lines, or of press-forming the saw-tooth pattern in registration with the alternating lines. Using the materials set forth in U.S. Pat. No. 2,407,680, as an illustration, the actual coating may be applied by offset lithographic printing techniques to form lines corresponding with the short nearly vertical faces of the final saw-tooth pattern. The clear spaces would then correspond with the larger nearly horizontal faces of this same pattern. The coating medium is preferably a solution of N-butyl-methacrylate polymer resin and xylol to which a transparent red dye has been added. The proportion of resin and xylol should be adjusted to produce a dry layer thickness of approximately 0.8 to 0.9 mils. After coating, the material is subjected to 140° F air for 25–30 minutes, and then 190° F air for 30–45 minutes.

Next, in exact register with the previous coating, a second coating is applied in similar fashion to the first. This coating material is a solution of N-butyl-methacrylate polymer resin and xylol which has a fluorescent red pigment incorporated with it. The proportion of resin and xylol may be adjusted to produce an effective dry layer thickness of 60% of the first layer. Prior to drying, lead silicate glass beads with a refractive index in excess of 2.0 and a diameter range of approximately 1.5 to 3.0 mils (NO 15 size) are spread over the ribbon and pressed into the printed resinous lines by means of a pressure roller. Immediately previous to rolling, the excess beads are removed. Like the first coating, the ribbon is then subjected to 140° F air for 20–30 minutes and then 20–30 minutes at 190° F to dry the bead binder coat.

Using the same offset print-coat technique, a final coat is then applied using N-butyl-methacrylate polymer resin and iso-butyl-methacrylate polymer resin in equal parts and again with xylol as the solvent. The proportion of resin and solvent may be adjusted to produce an effective dry layer thickness of approximately four times the thickness of the previous coatings. This is then subjected to 140° F air for 25–30 minutes and then 45–60 minutes at 190° F.

After thoroughly dry, the printed ribbon or strip will then be press-formed into a saw-tooth pattern with the short faces exactly in register with the offset coated retroreflecting lines. The saw-tooth pattern will then be bead coated over the entire surface with the same solution previously used as the overcoat for the beads. This will then be dried for 25–30 minutes at 140° F and then 190° F for 45–60 minutes. Finally a silicone layer 8 will be applied in order to reduce surface friction and thus offer greater resistance to wear.

As another example, one may laminate 2–5 mil while vinyl sheeting with 2–5 mil Lexan sheeting. A bead coating is then applied to a white vinyl surface of "Cadco" Cement No. 1508, and before drying, sprinkled with 2–3 mil lead silicate glass beads of refractive index $n \cong 2.0$. After thorough drying, this material is passed through two heated pressure rollers whose surface has a saw-tooth pattern in order to fold the glass beaded and laminated material into an accordian-pleated saw-tooth pattern. This folded sheeting is then passed between two more rollers with a pattern somewhat similar to the pressure rollers. The top roller will continuously supply a coating of N-butyl and iso-butyl methacrylate polymer resin containing a transparent red pigment to only the short faces of the saw-tooth pattern. After drying, the entire strip will be coated with clear colorless N-butyl and iso-butyl methacrylate polymer resin to serve as a protective coating to help maintain the integrity of the saw-tooth pattern surface. In addition, this surface will be covered with a colorless transparent layer or silicone which will reduce surface friction of tires and thus increase the material's resistance to wear.

As a third example, a thin layer of retroreflective plastic material, such as described in the beforementioned U.S. Pat. No. 2,824,502, may be applied to the surface and then embossed into wedgeshape strip form. If desired, one set of surfaces may be overcoated to provide different color or other reflective characteristics.

Figure 4:
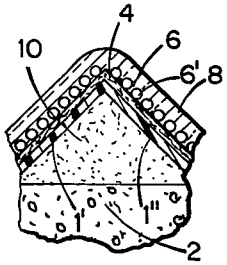
FIG. 4 is a fragmentary sectional view of a modified structure.

While the invention has been described in connection with the near-vertical preferred parallel planar wedge surfaces 1'' for the reasons explained, it has been found that satisfactory operation may be obtained for deviations of the angle with respect to the vertical of the surfaces 1'' up to, but not exceeding, about 45°. Such a more-triangular structure is shown in FIG. 4. Under such circumstances and limitations, a substantial vertical component for retroreflection exists, though not as effective as the near-vertical orientation of FIG. 1.

In some instances, moreover, the type of contrast between retroreflection and diffuse reflection may not be necessary; and, indeed, retroreflection may be desired on both sets of wedge surfaces, as more particularly also illustrated in the embodiment of FIG. 4. The latter would be useful, for example, in airport landing strips. Color differentiation of sets of wedge surfaces might then not be necessary. Thus, the angle of surfaces 1″ relative to the roadway surface may be in the range from about 45° to almost 90°, with surfaces 1″ disposed on strip 1 so that the retroreflective means is exposed to incident light at small acute angles relative to the roadway surface for retroreflection.

Further techniques for forming, and other modifications of construction, including even thicker wedges, or symmetrical wedges, if desired, will suggest themselves to those skilled in this art and are considered to fall within the spirit and scope of the invention as defined in the appended claims.

What is claimed is:

1. In combination with a roadway surface, a direction-indicating surface marker apparatus comprising a thin, elongated strip of substantially continuous solid-surface planar plastic material pre-formed separately from said roadway surface and adhered to said roadway surface by a thin layer of adhesive between the strip and the roadway surface, said strip being intermittently deformed upwardly to provide successive transversely-disposed contiguous wedges of saw-tooth cross-sectional configuration, each wedge having one substantially continuous solid surface inclining upwardly and another substantially continuous solid surface inclining downwardly; said downwardly inclining surfaces being integrally covered by retroreflective means, and presenting a predetermined color, said retroreflective means comprising a highly reflective layer and refractive elements thereon for conjointly reflecting incident light in a direction opposite to the direction of incidence, said downwardly inclining surfaces forming acute angles relative to the roadway surface that are in the range from about 45° to almost 90° and said downwardly inclining surfaces being disposed on said strip so that said retroreflective means is exposed to incident light at small acute angles relative to said roadway surface for retroreflection; said upwardly inclining surfaces being differently colored, said strip having sufficient structural strength to permit it to be handled and secured to said roadway surface and being substantially flat as a whole on said roadway surface so as to avoid tire chatter for vehicles riding over the strip.

2. A direction-indicating surface marker apparatus as claimed in claim 1 and in which the upwardly inclining surfaces are provided with optically diffuse reflecting properties.

3. A direction-indicating surface marker apparatus as claimed in claim 1 and in which the upwardly inclining surfaces are also integrally covered by retroreflective means.

4. A direction-indicating surface marker apparatus as claimed in claim 1 and in which said one and other surfaces are respectively relatively long and short, with the said one surface inclining upwardly at a small angle and substantially normal to the downwardly inclining surface such that the downwardly inclining surface is nearly vertical.

5. A direction-indicating surface marker apparatus as claimed in claim 4 and in which said small angle is of the order of about 10° with respect to the plane along the bottom of the strip, such that the angle of said downwardly inclining surfaces with respect to the normal to said plane is of substantially the same value, thus to present the downwardly inclining surfaces with their retroreflective means at substantially right angles to the direction of the line of sight of an approaching motorist and the like.

6. A direction-indicating surface marker apparatus as claimed in claim 1 and in which said surfaces are at substantially the same acute angle to the vertical not exceeding about 45°.

7. A direction-indicating surface marker apparatus as claimed in claim 1 and in which said retroreflective means comprises elements selected from the group consisting of optically refractive spheres, beads, cylinders and fibers.

8. A direction-indicating surface marker apparatus as claimed in claim 1 and in which the predetermined color is contained on the reflecting downwardly inclining surfaces.

9. A direction-indicating surface marker apparatus as claimed in claim 1 and in which the predetermined color is contained in the retroreflective means.

10. A direction-indicating surface marker apparatus as claimed in claim 1 and in which said strip is coated with a hard protective, substantially colorless, smooth overcoating layer.

11. A direction-indicating surface marker apparatus as claimed in claim 10 and in which said retroreflective means comprise a plurality of lead silicate glass members in an N-butyl-methacrylate binder containing a highly reflective red fluorescent pigment.

12. In combination with a roadway surface, a direction-indicating surface marker apparatus comprising a thin, elongated strip of substantially continuous solid-surface planar plastic material pre-formed separately from said roadway surface and adhered to said roadway surface by a thin layer of adhesive between the strip and the roadway surface, said strip being intermittently deformed upwardly to provide successive transversely-disposed contiguous wedges of saw-tooth cross-sectional configuration, each wedge having one substantially continuous solid surface inclining upwardly and another substantially continuous solid surface inclining downwardly; one of said surfaces being integrally covered by retroreflective means and presenting a predetermined color, said retroreflective means comprising a highly reflective layer and refractive elements thereon for conjointly reflecting incident light in a direction opposite to the direction of incidence, said one surface forming an acute angle relative to the roadway surface that is in the range from about 45° to almost 90° and said one surface being disposed on said strip so that said retroreflective means is exposed to incident light at small acute angles relative to said roadway surface for retroreflection; and the other surface being provided with a reflecting surface providing one of optical diffusion reflection, and retroreflection, said strip having sufficient structural strength to permit it to be handled and secured to said roadway surface and being substantially flat as a whole on said roadway surface so as to avoid tire chatter for vehicles riding over the strip.

13. A direction-indicating surface marker apparatus as claimed in claim 12 and in which said one and other surfaces are differently colored.

14. A direction-indicating surface marker apparatus as claimed in claim 12 and in which said one and other surfaces are similarly colored.

* * * * *